US006382815B1

(12) United States Patent
Klearman et al.

(10) Patent No.: US 6,382,815 B1
(45) Date of Patent: May 7, 2002

(54) ENERGIZED BODY JEWELRY

(75) Inventors: Jeffrey D. Klearman, Austin, TX (US); William R. Wilkinson, Scottsdale, AZ (US)

(73) Assignee: JJK Industries, L.P., Austin, TX (US)

( * ) Notice: Subject to any disclaimer, the term of this patent is extended or adjusted under 35 U.S.C. 154(b) by 0 days.

(21) Appl. No.: 09/571,986

(22) Filed: May 16, 2000

(51) Int. Cl.[7] ..... F21V 33/00

(52) U.S. Cl. ..... 362/253; 362/104; 601/46; 601/70; 63/1.1

(58) Field of Search ..... 63/1.1, 2, 31; 601/46, 601/67, 70, 72; 362/104, 253

(56) References Cited

U.S. PATENT DOCUMENTS

| | | | | | |
|---|---|---|---|---|---|
| 859,674 | A | * | 7/1907 | Lindstrom | |
| 3,362,401 | A | * | 1/1968 | Katz | 601/46 |
| 3,504,665 | A | * | 4/1970 | Bakunin et al. | 126/36 |
| 3,580,246 | A | * | 5/1971 | Foreman | 601/72 |
| 3,779,238 | A | * | 12/1973 | Cutler et al. | 128/36 |
| 3,900,023 | A | * | 8/1975 | McBride | 128/36 |
| 3,991,751 | A | * | 11/1976 | O'Rourke | 128/36 |
| RE29,687 | E | * | 7/1978 | Sertich | 32/56 |
| 4,802,070 | A | * | 1/1989 | Westmoland | 362/104 |
| 5,622,062 | A | * | 4/1997 | Gong-Hwa | 63/15 |
| 5,857,984 | A | * | 1/1999 | deBoer et al. | 600/595 |
| 6,203,401 | B1 | | 3/2001 | Duboff | 601/70 |

OTHER PUBLICATIONS

Hoag Levins: *American Sex Machines: The Hidden History of Sex at the U.S. Patent Office*, 1996; pp. 210–222 and 272.*

World–Pop Body Jewellery—Australasia's Body Piercing Supplies Specialists UV Acrylic Body Piercing Jewelry (Jewellry) from World–Pop www.world–pop.co.nz/uv.htm [May 15 2000].*

* cited by examiner

*Primary Examiner*—Stephen Husar

(57) ABSTRACT

Energized body jewelry including alternative embodiments designed to be worn by persons who have piercings in their bodies, as well as for those who do not have piercings. In one embodiment, the jewelry may be worn by a person with a piercing by attaching the jewelry with a barbell style piercing including a slotted retainer sized to carry the jewelry. In that same embodiment, the jewelry alternatively, through the use of an elastomeric band attachment means, may be worn by a person who does not have a piercing. The jewelry is energized such that it may vibrate, illuminate, or perform other functions requiring energy from some extracorporeal source such as a battery.

28 Claims, 15 Drawing Sheets

ENERGIZED BODY JEWELRY

BACKGROUND AND SUMMARY

The present invention relates generally to body jewelry including alternative embodiments designed to be worn by persons who have piercings in their bodies as well as for those who do not. Although body piercing in today's society has been shifting from a counterculture dominated practice to an increasingly popular activity, a substantial number of persons who could be inclined to join the body piercing community are not quite ready to take that leap. The present invention provides unique energized body jewelry that can be worn by members of the piercing community, but also provides an alternative embodiment that can be worn by those who have not had their bodies pierced.

In one embodiment, the jewelry may be worn by a person with a piercing by attaching the jewelry with a standard barbell style piercing including a slotted retainer sized to carry the jewelry. In that same embodiment, the jewelry alternatively, through the use of an elastomeric band attachment means, may be worn by a person who does not have a piercing. The jewelry is energized such that it may vibrate, illuminate, or perform other functions requiring energy from some extracorporeal source such as a battery.

The energizing feature of the invention provides for many alternative uses ranging from the primarily ornamental aspect of an embodiment including an illuminating light source, to the more functional aspects provided through the preferred embodiment including a vibrator.

The objects and potential uses of the present invention will become readily apparent upon further review of the following description, and various other features and attendant advantages will become more fully appreciated as the invention becomes better understood when considered in conjunction with the accompanying drawings, in which like reference characters designate the same or similar parts throughout the several views.

DETAILED DESCRIPTION

Figure 1:
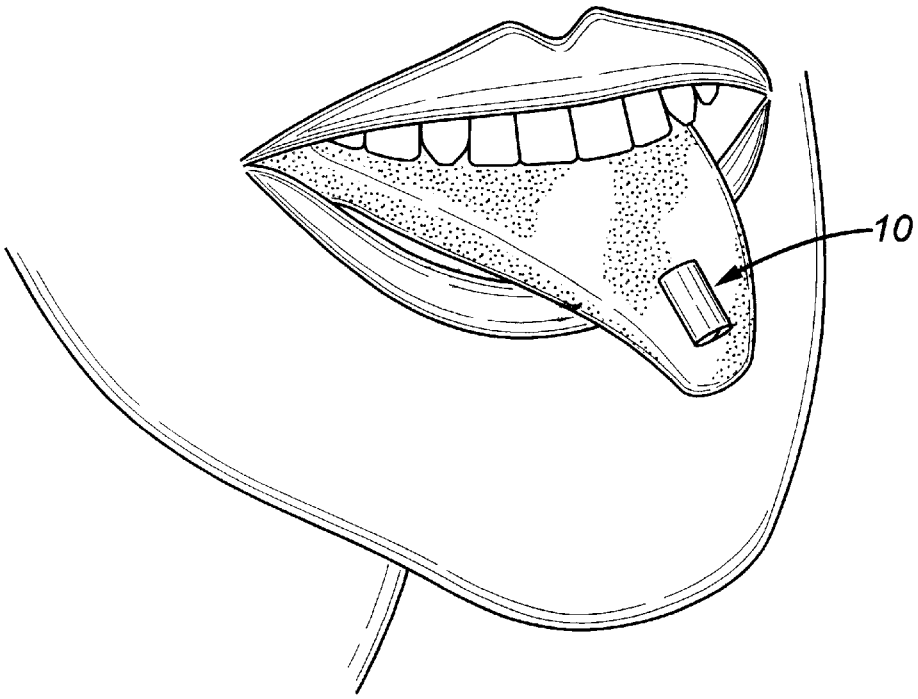
FIG. 1 is a perspective view of an embodiment of the invention attached to a person's tongue.
Figure 1A:
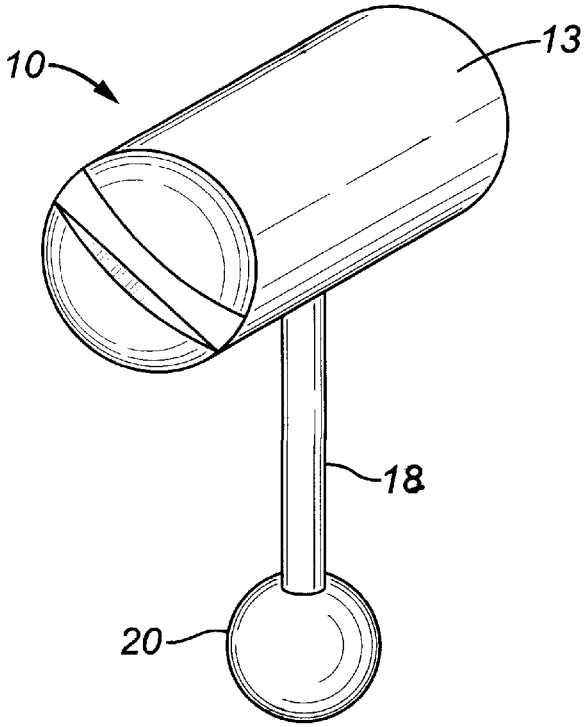
FIG. 1A is a perspective view of an embodiment of the invention.
Figure 1B:
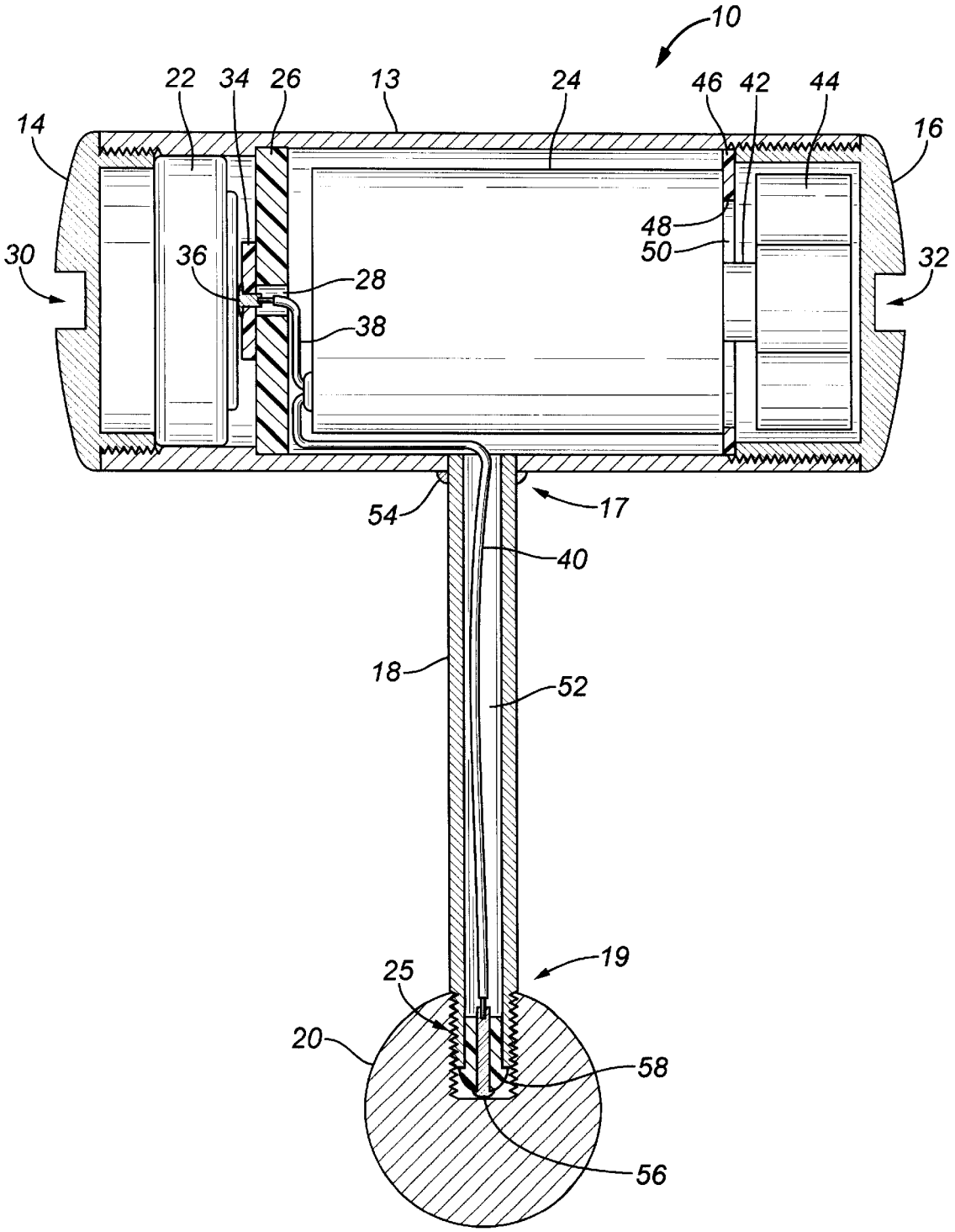
FIG. 1B is a cross-sectional view of an embodiment of the invention.

FIG. 1 is a perspective view of an embodiment of the invention attached to a person's tongue. As shown in FIG. 1, jewelry 10 can be worn as a barbell style tongue piercing. Jewelry 10 is shown in FIG. 1A as comprised of vibrator housing 13, post 18, and retainer 20. FIG. 1B is a cross-sectional view of a single-battery embodiment of the invention. In this embodiment, battery 22 is located within vibrator housing 13. The vibrator is comprised of electromagnetic motor 24, rotor shaft 42, and eccentric rotor 44. Motor 24 is secured within housing 13 by motor shim 46, which has an opening 48 that matches motor shoulder 50. Vibrator housing 13 is closed at the rotor end by threaded rotor end cap 16, which is screwed into place with the help of rotor end cap slot 32.

As shown in FIG. 1B, the single-battery embodiment of the invention is powered by battery 22, which is secured within housing 13 by threaded battery end cap 14. Battery end cap 14 can be screwed into place with the help of battery end cap slot 30. Battery 22 is placed into housing 13 with the cathode negative electrode end first. The negative end of battery 22 contacts negative battery contact 36, which is held within battery shim 34. When battery end cap 14 is screwed into place, it contacts the anode positive electrode end of battery 22. Plastic septum 26 insulates the negative end of battery 22 from housing 13. Negative motor lead wire 38 is fed through septum opening 28, and terminates with negative battery contact 36.

As further shown in FIG. 1B, positive motor lead wire 40 is fed through passage 52 in elongated post 18, where positive motor lead wire 40 terminates with positive contact 56. Post 18 at its top end 17 is press fit into housing 13 and secured by weld 54. Contact tip assembly 25 is comprised of positive contact 56 and insulating post tip 58, which are attached within bottom end 19 of post 18. Positive contact 56 is insulated from post 18 by insulating post tip 58.

Retainer 20 is screwed onto the threaded bottom end 19 of post 18. When retainer 20 is screwed into place, the circuit between battery 22 and motor 24 is completed as retainer 20 engages positive battery contact 56. When retainer 20 engages contact 56, the circuit is completed as positive contact 56 electrically communicates with retainer 20, which is connected to post 18, and through housing 13 and battery end cap 14, which is in contact with the positive end of battery 22. A person wearing jewelry 10 as a barbell style tongue piercing may turn on the vibrator by screwing down retainer 20 to the point at which it engages contact 56, and then turn off the vibrator by slightly backing off the threads of retainer 20. This inventive on-off switch feature is accomplished with a threaded retainer, which is the standard barbell style tongue jewelry attachment mechanism, operating as the only necessary moving part other than the vibrator itself.

Figure 2:
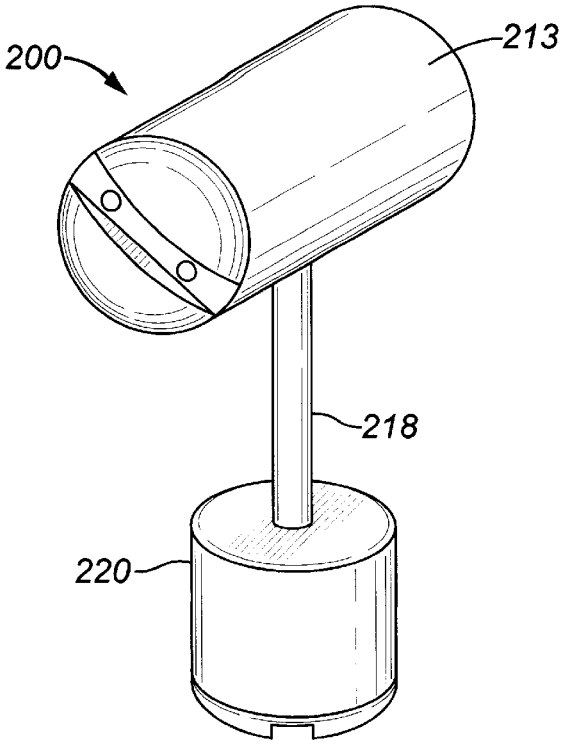
FIG. 2 is a perspective view of an alternative embodiment of the invention that includes a battery in the retainer.
Figure 2A:
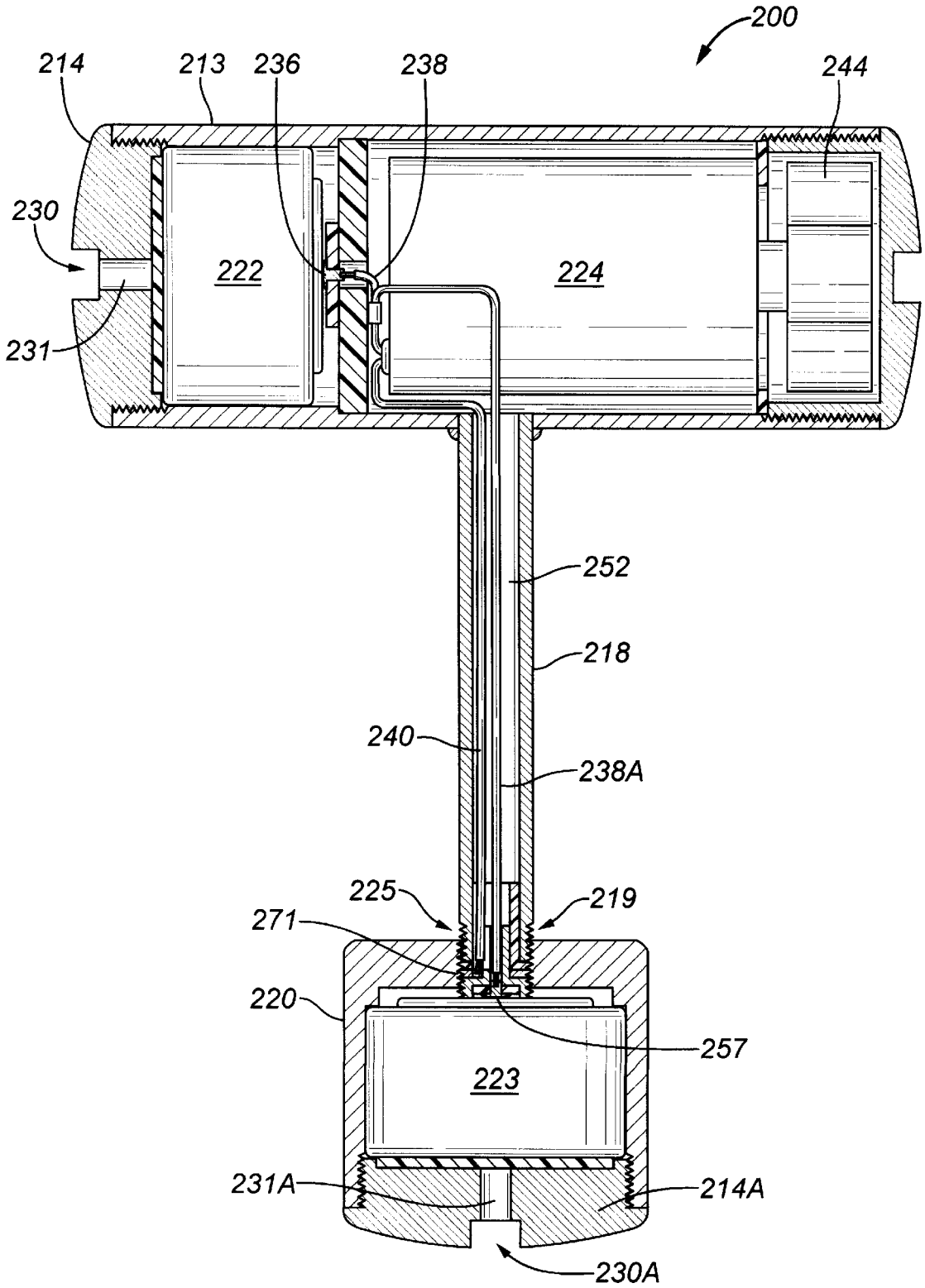
FIG. 2A is a cross-sectional view of an alternative embodiment of the invention that includes a battery in the retainer.

FIG. 2 is a perspective view of an alternative embodiment of the invention that includes a battery within the retainer as well as in the vibrator housing. Jewelry 200 is shown in FIG. 2 as comprised of vibrator housing 213, post 218, and retainer 220. Jewelry 200 can be worn as a barbell style tongue piercing. FIG. 2A is a cross-sectional view of this dual-battery embodiment of the invention. In this alternative embodiment, battery 222 is located within vibrator housing 213, and battery 223 is located within retainer 220. The vibrator is comprised of electromagnetic motor 224 and eccentric rotor 244. Battery end caps 214 and 214A can be screwed into place with the help of battery end cap slots 230 and 230A, which further include vent holes 231 and 231A to allow air to energize the batteries.

As shown in FIG. 2A, batteries 222 and 223 are connected in parallel to motor 224. Batteries 222 and 223 are placed into housing 213 and retainer 223 with the cathode negative electrode end first. The negative lead wire from motor 224 branches off into negative lead wire 238, which terminates at negative battery contact 236, and negative lead wire 238A, which is fed through passage 252 in elongated post 218, where it terminates at negative battery contact 257. As further shown in FIG. 2A, positive motor lead wire 240 is fed through passage 252 in elongated post 218, where it terminates at positive contact ring 271 within contact tip assembly 225.

Figure 2B:
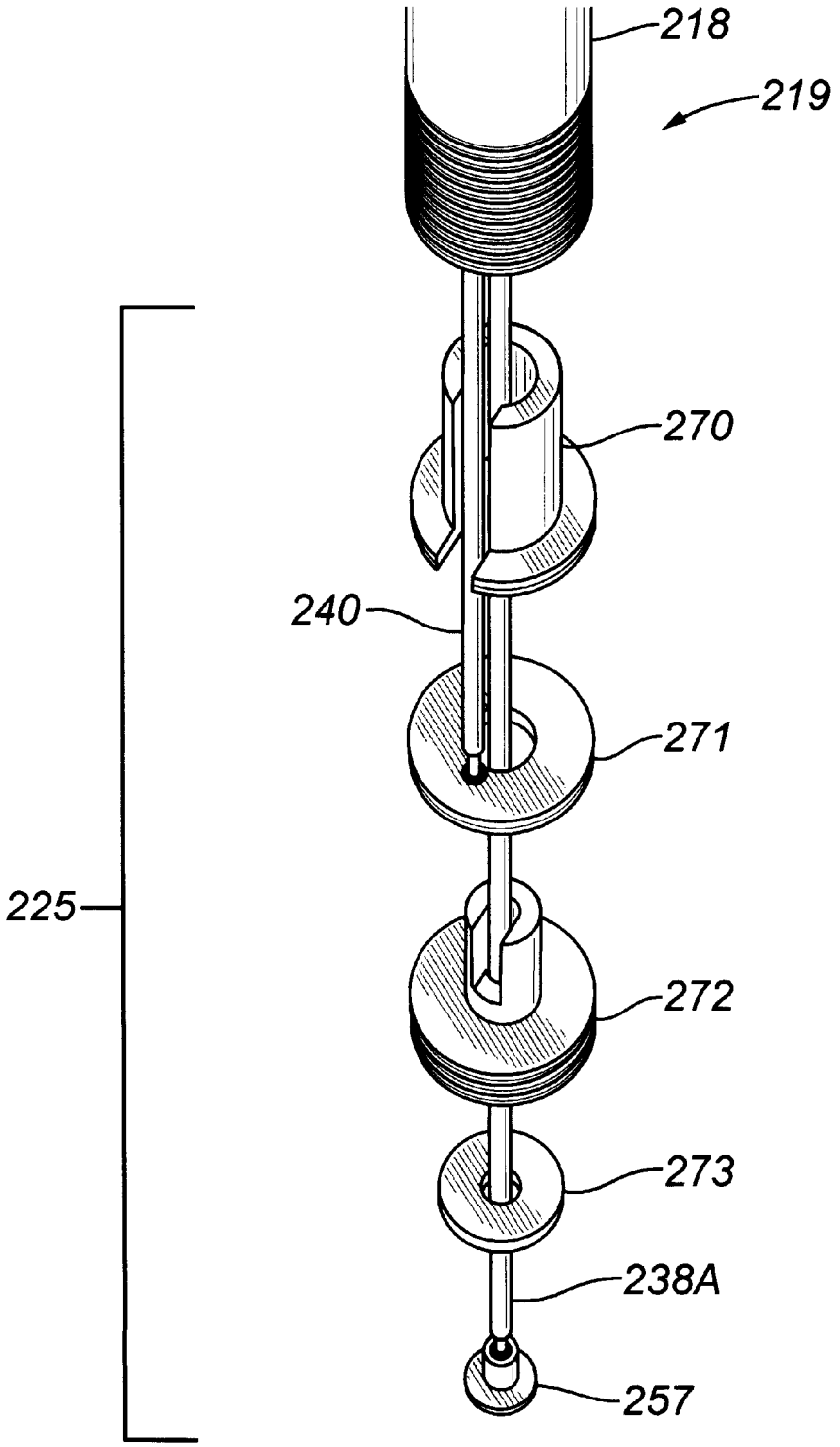
FIG. 2B is an exploded view of the post tip assembly of an alternative embodiment of the invention that includes a battery in the retainer.

FIG. 2B is an exploded view of contact tip assembly 225, which is comprised of post insulator 270, positive contact ring 271, tip insulator 272, tip spacer 273, and negative battery contact tip 257, each of which is attached at bottom end 219 of post 218. Positive motor lead wire 240 terminates at positive contact ring 271, and negative motor lead wire 238A terminates at negative battery contact 257. Post insulator 270 insulates contact tip assembly 225 from post 218, and tip insulator 272 insulates negative battery contact tip 257 from positive contact ring 271.

Referring back to FIG. 2A, retainer 220 is screwed onto the threaded bottom end 219 of post 218. When retainer 220 is screwed into place, the parallel circuit between batteries 222 and 223, and motor 224, is completed as the negative end of battery 223 within retainer 220 engages negative battery contact 257, and the internal threads of retainer 220 turn pass and engage positive contact ring 271. When the negative end of battery 223 engages contact 257, and the internal threads of retainer 220 engage contact ring 257, the parallel circuit is completed as positive contact ring 271 electrically communicates with retainer 220, which is connected to post 218, and through housing 213 and battery end cap 214, which is in contact with the positive end of battery 222.

A person wearing jewelry 200 as a barbell style tongue piercing may turn on the vibrator by screwing down retainer 220 to the point at which it engages contact 257, and then turn off the vibrator by slightly backing off the threads of retainer 220. This inventive on-off switch feature is accomplished with a threaded retainer, which is the standard barbell style tongue jewelry attachment mechanism, operating as the only necessary moving part other than the vibrator itself.

Figure 3:
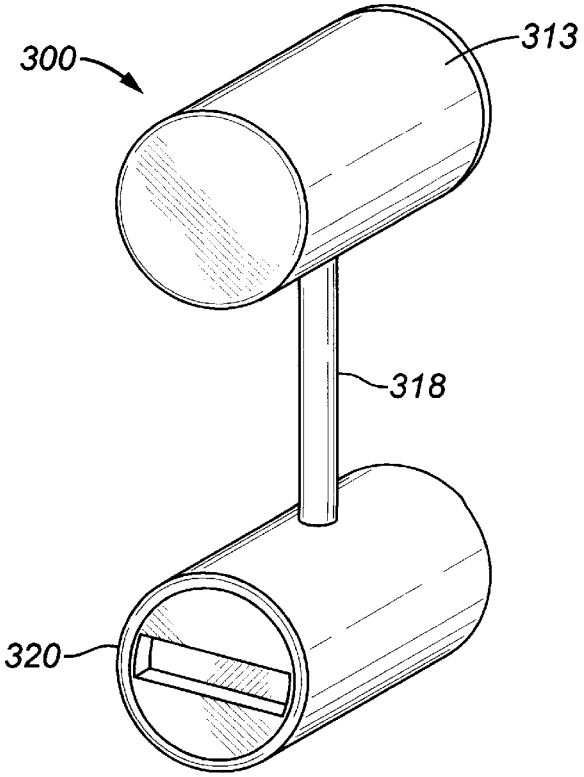
FIG. 3 is a perspective view of an alternative embodiment of the invention that includes two batteries in the retainer.
Figure 3A:
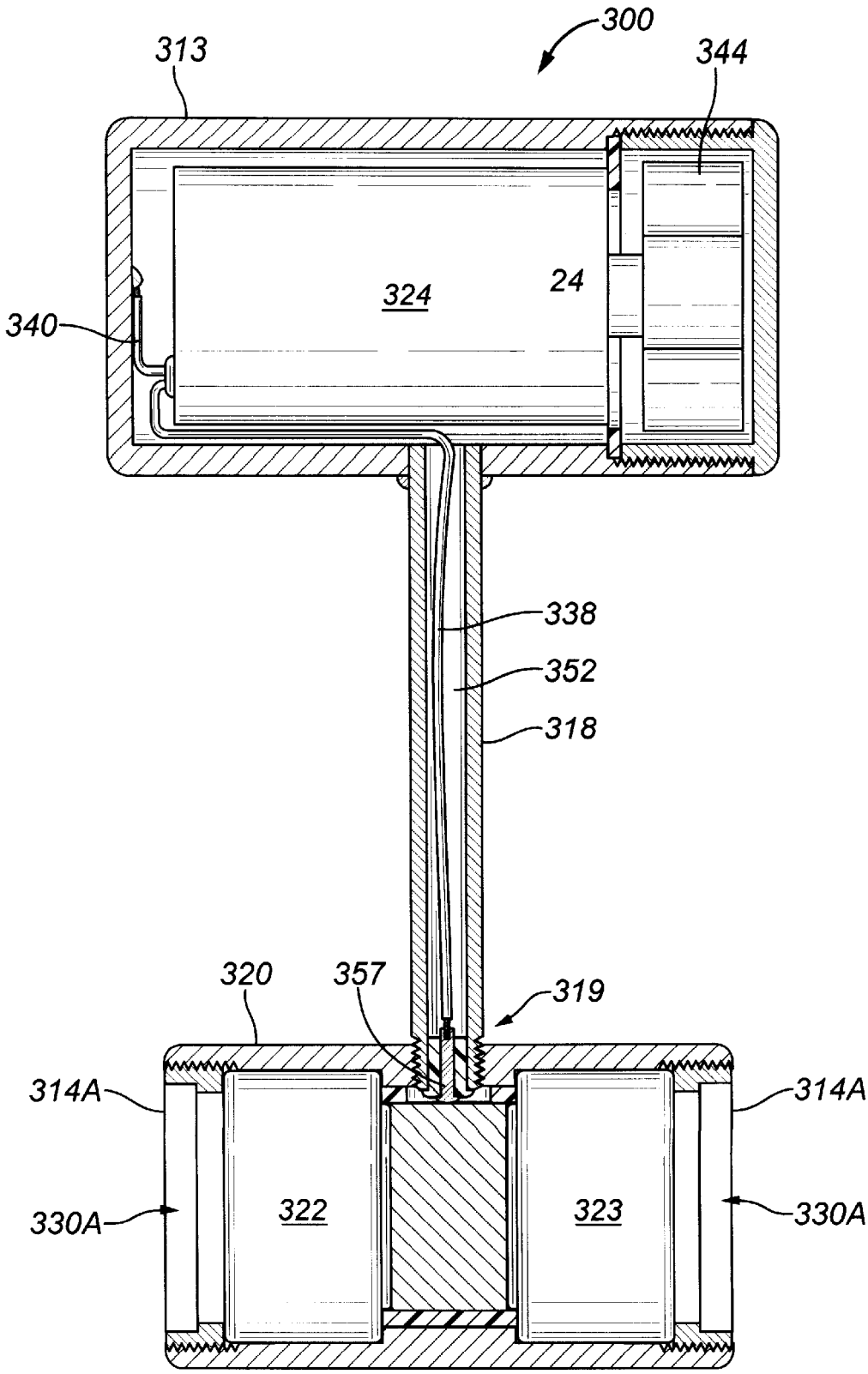
FIG. 3A is a cross-sectional view of an alternative embodiment of the invention that includes two batteries in the retainer.

FIG. 3 is a perspective view of an alternative embodiment of the invention that includes two batteries within the retainer. Jewelry 300 is shown in FIG. 3 as comprised of vibrator housing 313, post 318, and retainer 320. Jewelry 300 can be worn as a barbell style tongue piercing. FIG. 3A is a cross-sectional view of this dual-battery embodiment of the invention. In this alternative embodiment, batteries 322 and 323 are located within retainer 320. The vibrator is comprised of electromagnetic motor 324 and eccentric rotor 344. Battery end caps 314A are screwed into place with the help of battery end cap slots 330A, which also operate as vent holes to allow air to energize the batteries.

As shown in FIG. 3A, batteries 322 and 323 are connected in parallel to motor 324. Batteries 322 and 323 are placed into retainer 320 with the cathode negative electrode end first. Positive lead wire 340 from motor 324 is attached to the inner periphery of housing 313. Negative lead wire 338 is fed through passage 352 in elongated post 318, where it terminates at negative battery contact 357.

As further shown in FIG. 3A, retainer 320 is screwed onto the threaded bottom end 319 of post 318. When retainer 320 is screwed into place, the parallel circuit between batteries 322 and 323, and motor 324, is completed as the negative ends of batteries 322 and 323 within retainer 320 communicate with negative battery contact 357. When retainer 320 is screwed into place, the positive ends of batteries 322 and 323 communicate with positive motor lead wire 340 through housing 313, elongated post 318, retainer 320, and battery end caps 314A.

A person wearing jewelry 300 as a barbell style tongue piercing may turn on the vibrator by screwing down retainer 320 to the point at which it engages contact 357, and then turn off the vibrator by slightly backing off the threads of retainer 320. This inventive on-off switch feature is accomplished with a threaded retainer, which is the standard barbell style tongue jewelry attachment mechanism, operating as the only necessary moving part other than the vibrator itself.

Figure 4:
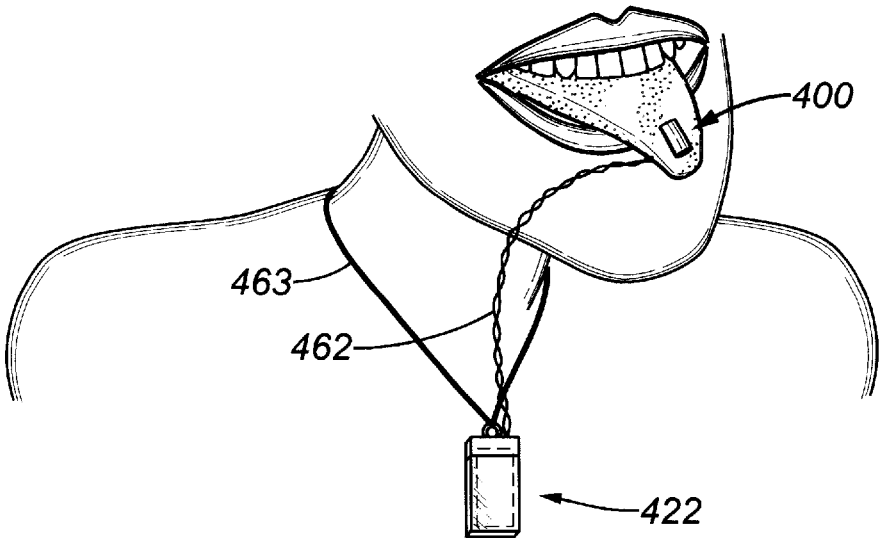
FIG. 4 is a perspective view of an alternative embodiment of the invention attached to a person's tongue, with an external power supply carried by a necklace.
Figure 4A:
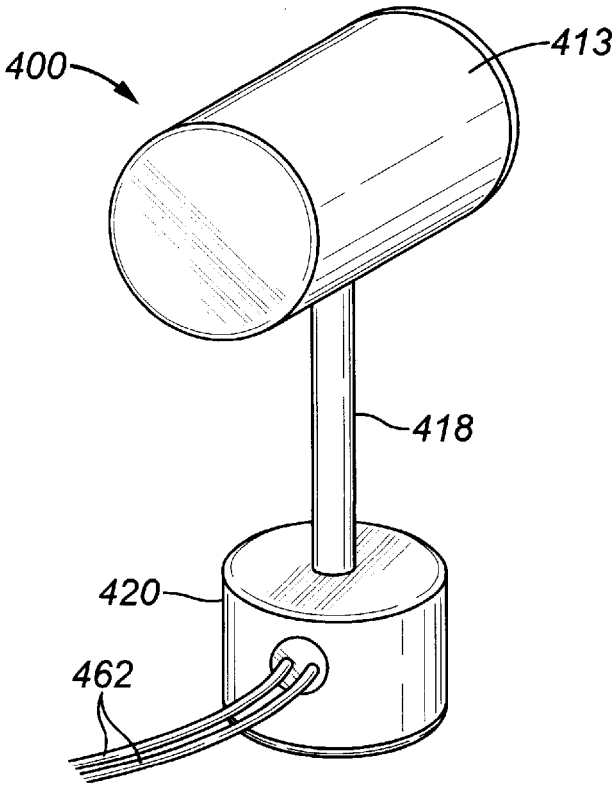
FIG. 4A is a perspective view of an alternative embodiment of the invention that operates with an external power supply.

FIG. 4 is a perspective view of an alternative embodiment of the invention attached to a person's tongue, with an external power supply carried by a necklace. Jewelry 400 can be worn as a barbell style tongue piercing, with wires 462 connected to external power supply 422, which is carried by necklace 463. Jewelry 400 is shown in FIG. 4A as comprised of vibrator housing 413, post 418, retainer 420, and external wires 462.

Figure 4B:
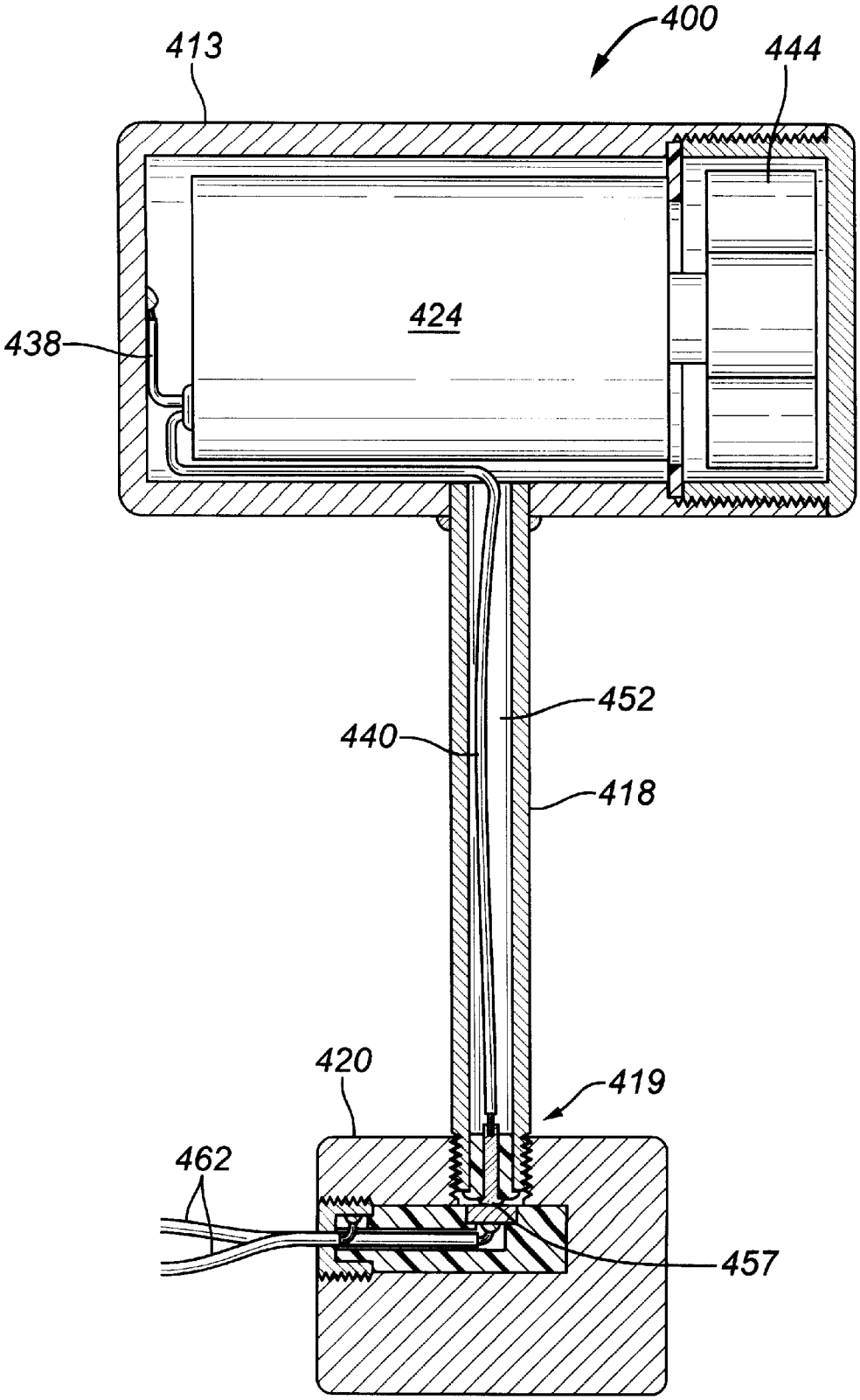
FIG. 4B is a cross-sectional view of an alternative embodiment of the invention that operates with an external power supply.

FIG. 4B is a cross-sectional view of this externally powered embodiment of the invention. In this alternative embodiment, the vibrator is comprised of electromagnetic motor 424 and eccentric rotor 444. Negative lead wire 438 from motor 424 is attached to the inner periphery of housing 413. Positive lead wire 440 is fed through passage 452 in elongated post 418, where it terminates at positive battery contact 457.

As further shown in FIG. 4B, retainer 420 is screwed onto the threaded bottom end 419 of post 418. When retainer 420 is screwed into place, the circuit between motor 424 and an external power supply connected to wires 462 is completed as the positive lead of wires 462 communicates with positive contact 457. When retainer 420 is screwed into place, the negative lead of wires 462 communicates with negative motor lead wire 438 through housing 413, elongated post 419, and retainer 420.

A person wearing jewelry 400 as a barbell style tongue piercing may turn on the vibrator by screwing down retainer 420 to the point at which it engages contact 457, and then turn off the vibrator by slightly backing off the threads of retainer 420. This inventive on-off switch feature is accomplished with a threaded retainer, which is the standard barbell style tongue jewelry attachment mechanism, operating as the only necessary moving part other than the vibrator itself.

Figure 5:
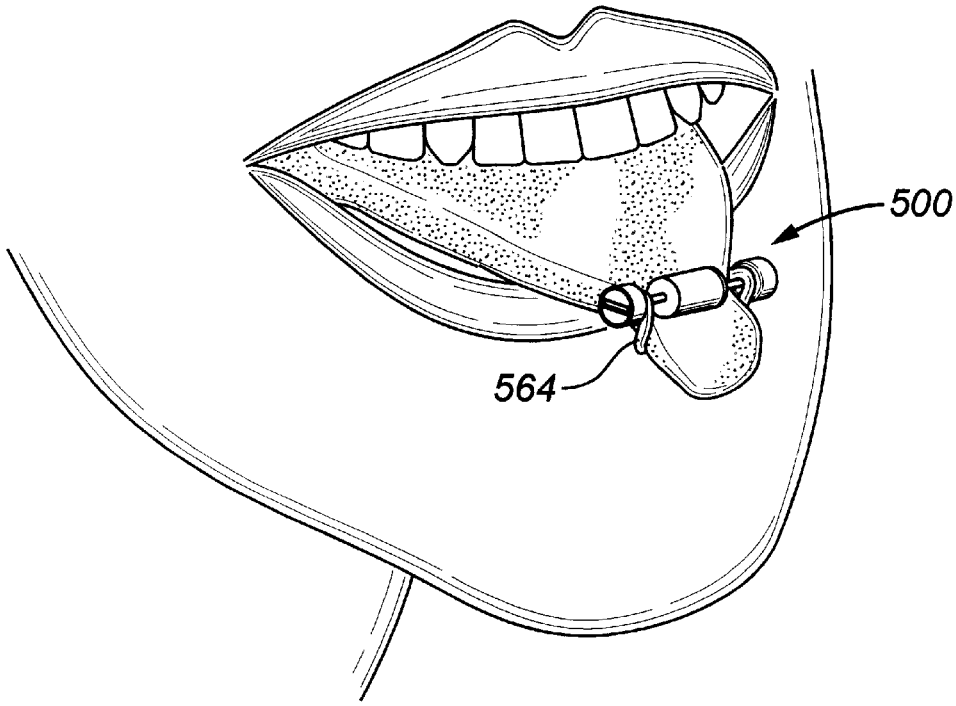
FIG. 5 is a perspective view of an alternative embodiment of the invention attached to a person's tongue with an elastomeric band.
Figure 5A:
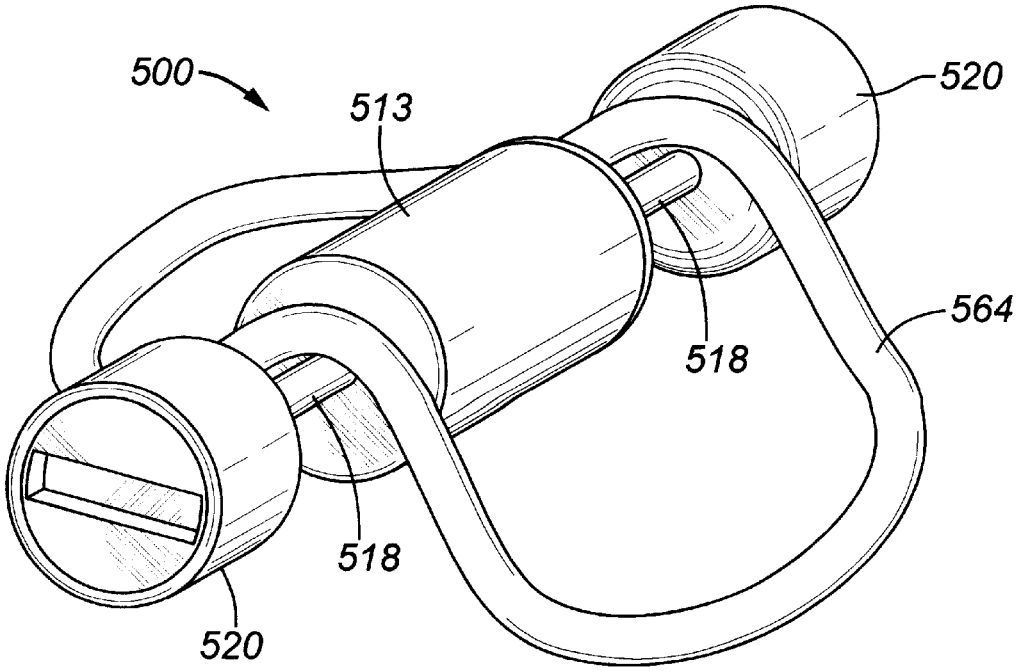
FIG. 5A is a perspective view of an alternative embodiment of the invention that includes a battery in each of two outer peripheral retainers, and an elastomeric band as its means of attachment.

FIG. 5 is a perspective view of an alternative embodiment of the invention attached to a person's tongue with an elastomeric band. Jewelry 500 is shown in FIG. 5 as attached to a person's tongue with elastomeric band 564. FIG. 5A is a perspective view of this alternative embodiment of the invention that includes a battery in each of two outer peripheral retainers 520. Jewelry 500 is shown in FIG. 5A as comprised of vibrator housing 513, posts 518, outer peripheral retainers 520, and elastomeric band 564. Through the use of the elastomeric band attachment means, jewelry 500 can be worn by a person who does not have a pierced tongue.

Figure 5B:
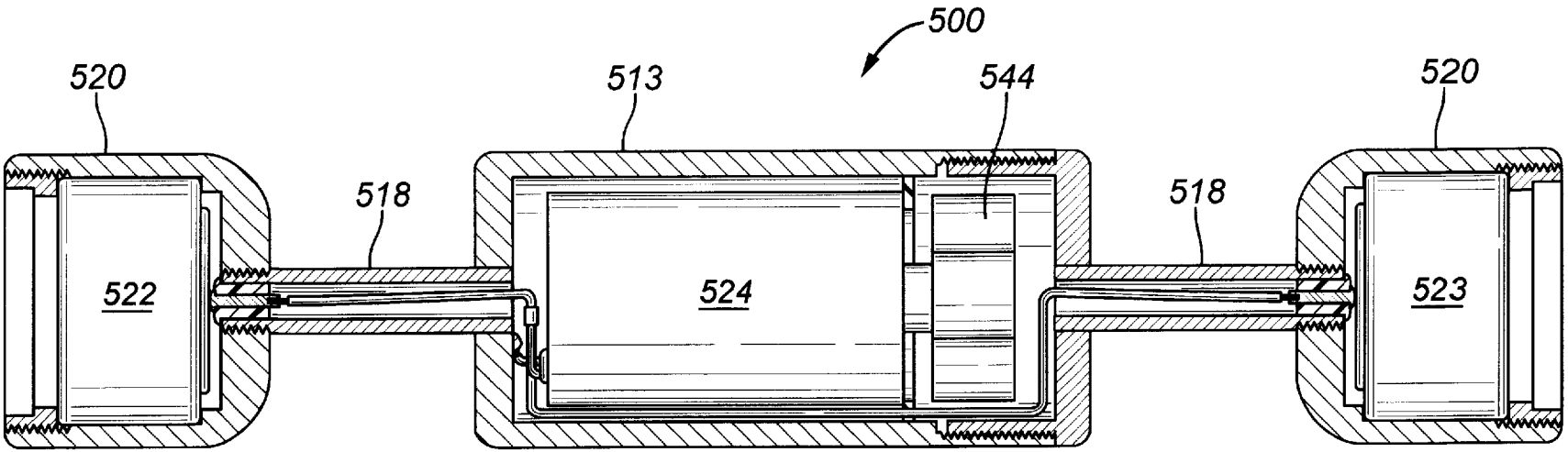
FIG. 5B is a cross-sectional view of an alternative embodiment of the invention that includes a battery in each of two outer peripheral retainers.

FIG. 5B is a cross-sectional view of this dual-battery non-piercing embodiment of the invention. In this alternative embodiment, batteries 522 and 523 are located within outer peripheral retainers 520. Retainers 520 are connected to vibrator housing 513 by posts 518. The vibrator is comprised of electromagnetic motor 524 and eccentric rotor 544.

As shown in FIG. 5B, retainers 520 are screwed onto the threaded ends of posts 518. When retainers 520 are screwed into place, the parallel circuit between batteries 522 and 523, and motor 524, is completed as the negative ends of batteries 522 and 523 within retainers 520 communicate with the negative lead wire of motor 524. When retainers 520 are screwed into place, the positive ends of batteries 522 and 523 communicate with the positive lead wire of motor 524 through housing 513, elongated posts 518, and retainers 520. A person wearing jewelry 500 may turn on the vibrator by screwing down retainers 520 to their seated position, and then turn off the vibrator by slightly backing off the threads of retainers 520.

Figure 6:
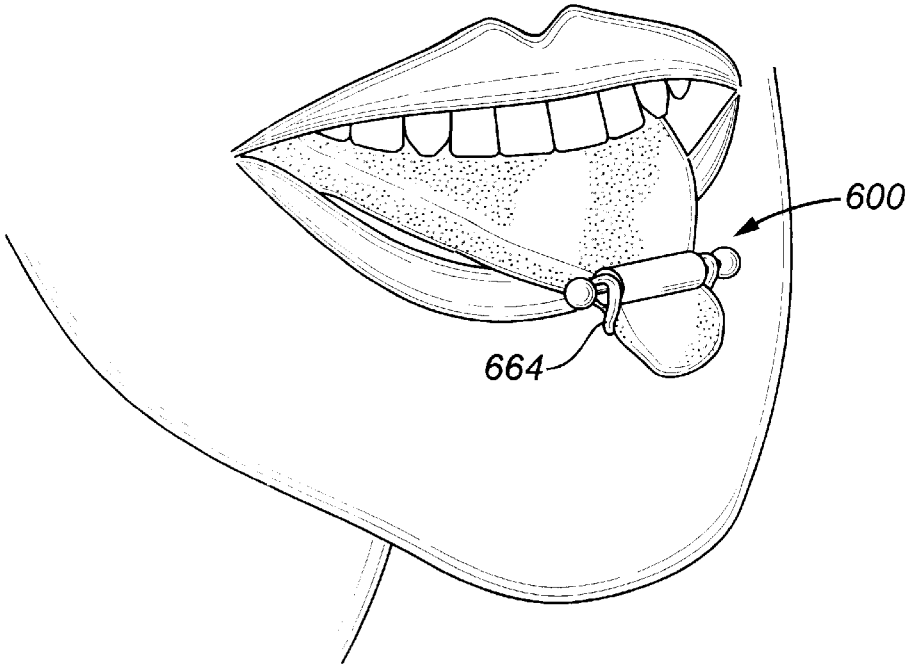
FIG. 6 is a perspective view of an alternative embodiment of the invention attached to a person's tongue with an elastomeric band.
Figure 6A:
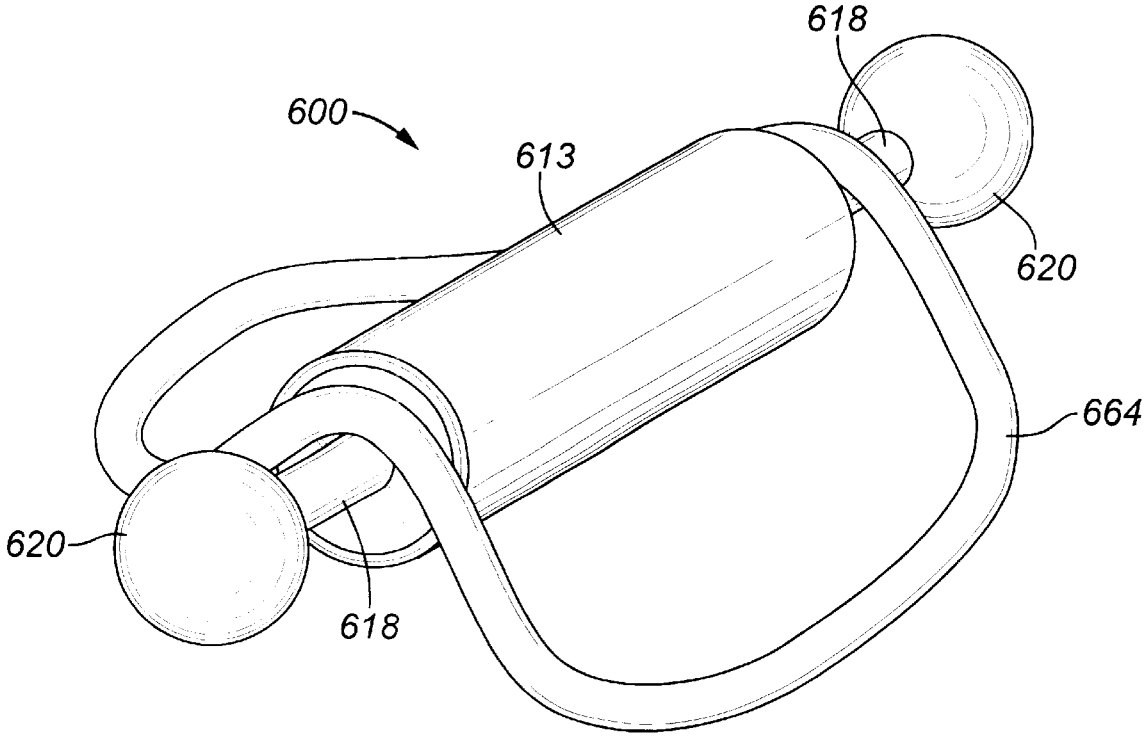
FIG. 6A is a perspective view of an alternative embodiment of the invention that includes two batteries within the vibrator housing, and an elastomeric band as its means of attachment.

FIG. 6 is a perspective view of an alternative embodiment of the invention attached to a person's tongue with an elastomeric band. Jewelry 600 is shown in FIG. 6 as attached to a person's tongue with elastomeric band 664. FIG. 6A is a perspective view of this alternative embodiment of the invention that includes two batteries within the vibrator housing. Jewelry 600 is shown in FIG. 6A as comprised of vibrator housing 613, posts 618, outer peripheral retainers 620, and elastomeric band 664. Through the use of the elastomeric band attachment means, jewelry 600 can be worn by a person who does not have a pierced tongue.

Figure 6B:
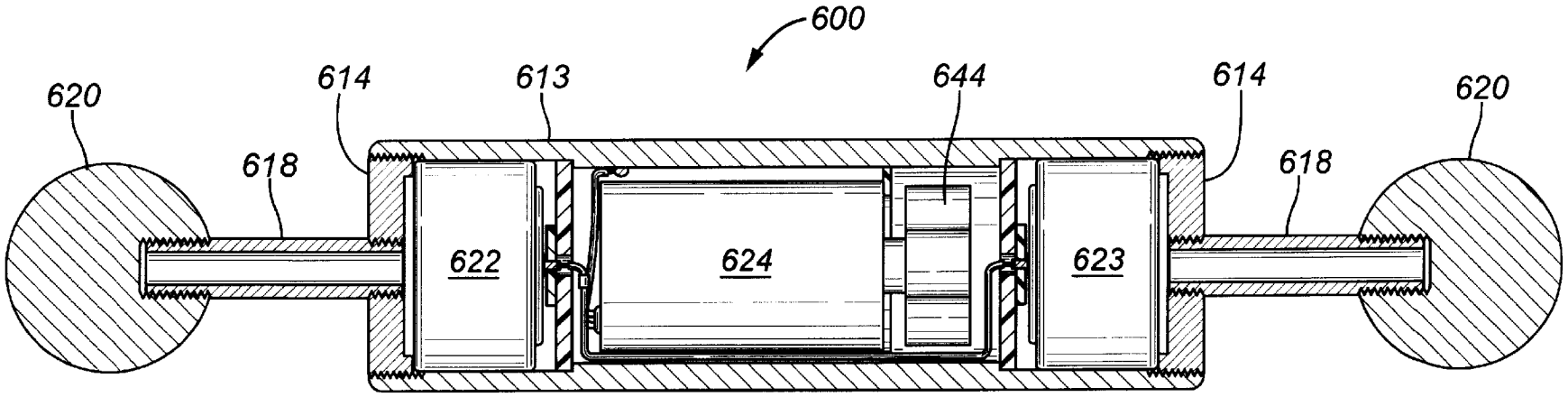
FIG. 6B is a cross-sectional view of an alternative embodiment of the invention that includes two batteries within the vibrator housing.

FIG. 6B is a cross-sectional view of this dual-battery non-piercing embodiment of the invention. In this alternative embodiment, batteries 622 and 623 are located within vibrator housing 613. Retainers 620 are connected to vibrator housing 613 by posts 618. The vibrator is comprised of electromagnetic motor 624 and eccentric rotor 644.

As shown in FIG. 6B, retainers 620 are screwed onto the threaded ends of posts 618. When battery end caps 614 are screwed into place, the parallel circuit between batteries 622 and 623, and motor 624, is completed as the negative ends of batteries 622 and 623 communicate with the negative lead wire of motor 624. When battery end caps 614 are screwed into place, the positive ends of batteries 622 and 623 communicate with the positive lead wire of motor 624 through housing 613. A person wearing jewelry 600 may turn on the vibrator by screwing down battery end caps 614 to their seated position, and then turn off the vibrator by slightly backing off the threads of battery end caps 614.

Figure 7:
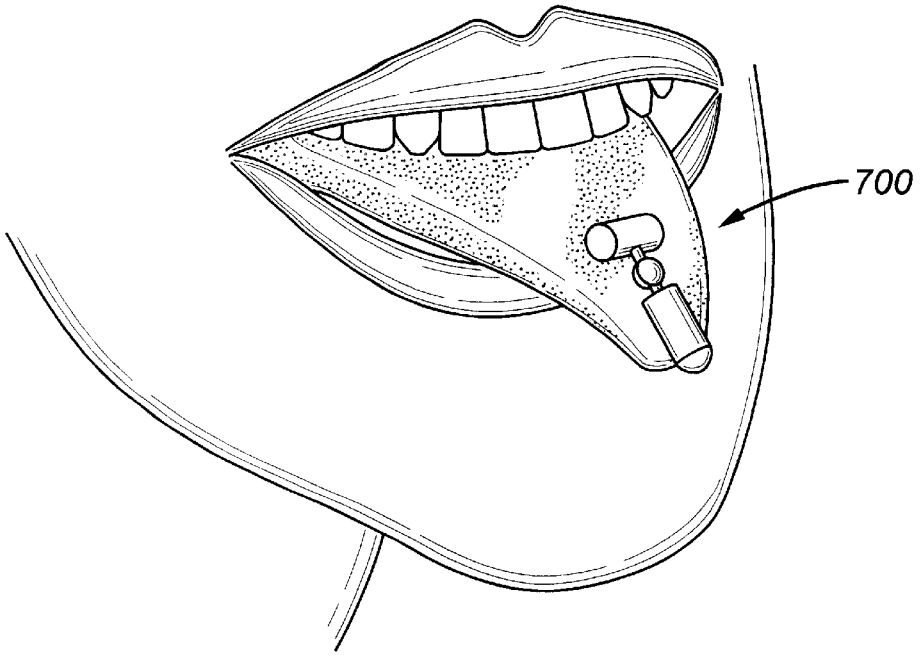
FIG. 7 is a perspective view of the preferred embodiment of the invention attached to a person's tongue with a slotted retainer.

FIG. 7 is a perspective view of the preferred embodiment of the invention attached to a person's pierced tongue. The preferred embodiment may be attached to a person's pierced tongue with a slotted retainer as shown in FIG. 7. Alternatively, through the use of an elastomeric band attachment means as shown in FIG. 7C, the preferred embodiment may be worn by a person who does not have a pierced tongue. This dual-use preferred embodiment of the invention includes two batteries in the retainer.

Figure 7A:
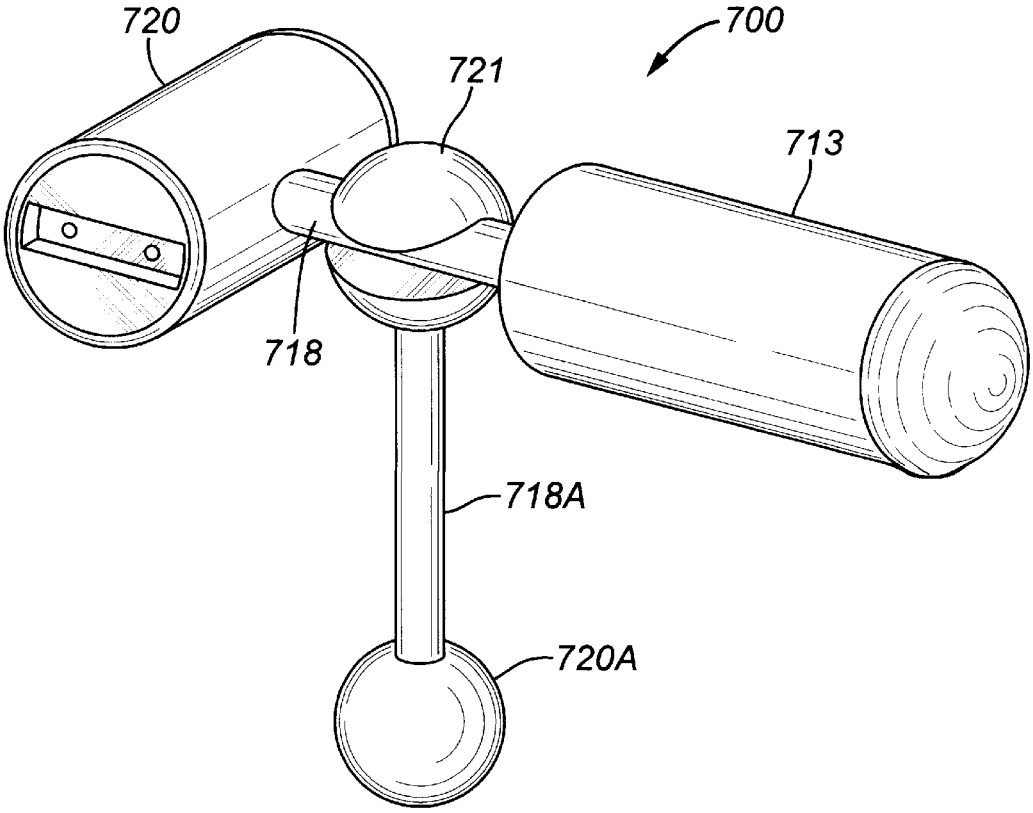
FIG. 7A is a perspective view of the preferred embodiment of the invention

Jewelry 700 is shown in FIG. 7A as comprised of vibrator housing 713, post 718, retainer 720, slotted retainer 721, secondary post 718A, and secondary retainer 720A. When jewelry 700 is worn by a person with a pierced tongue, slotted retainer 721, secondary post 718A, and secondary retainer 720A function as a standard barbell style tongue piercing, with the additional benefit that slotted retainer 721 has the capability to carry jewelry 700.

FIG. 7C is a perspective view of the preferred embodiment of the invention attached to a person's tongue with an elastomeric band. Jewelry 700 is shown in FIG. 7C as attached to a person's tongue with elastomeric band 764. This means of attachment may be used for an individual who does not have a pierced tongue.

Figure 7B:
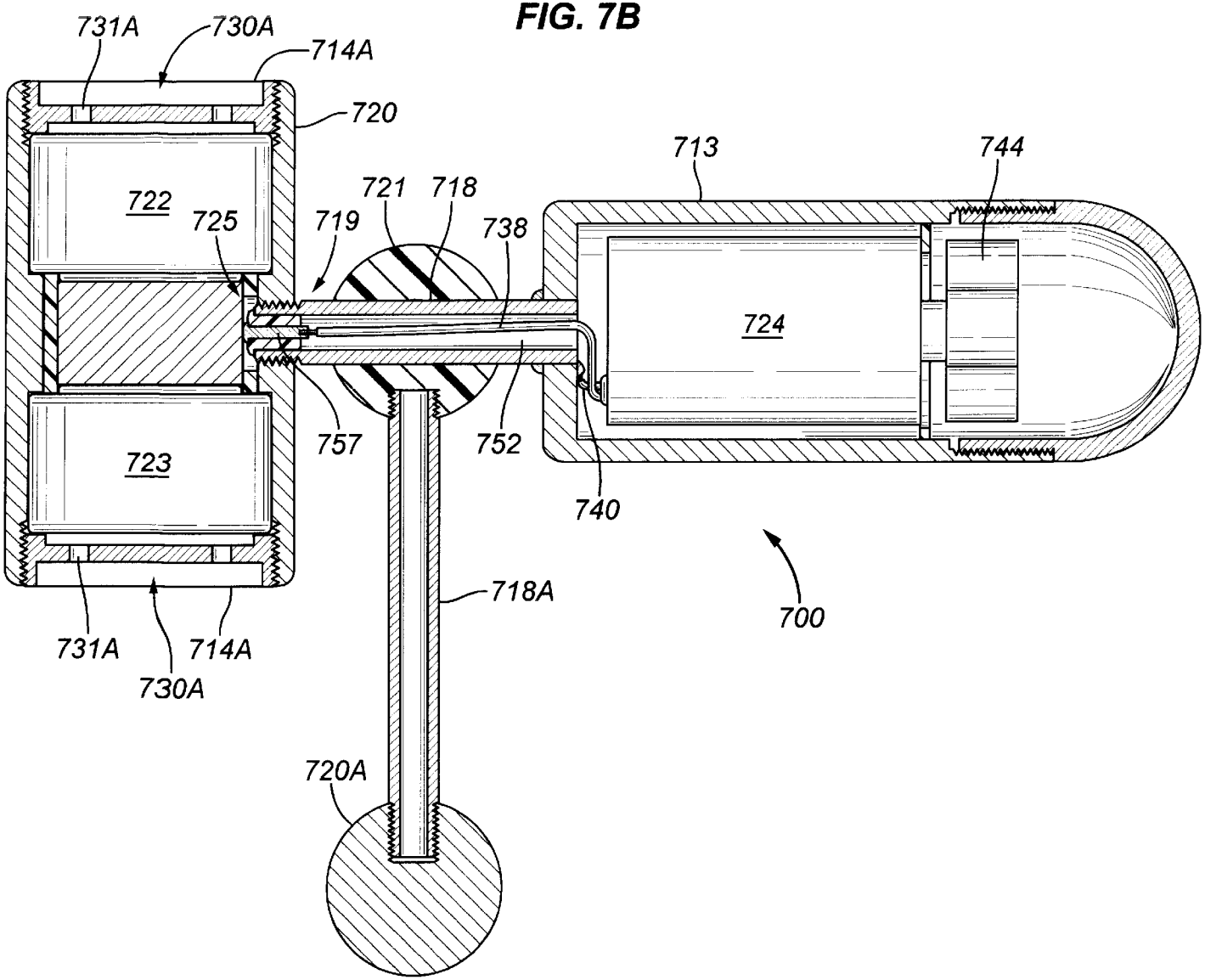
FIG. 7B is a cross-sectional view of the preferred embodiment of the invention.
Figure 7C:
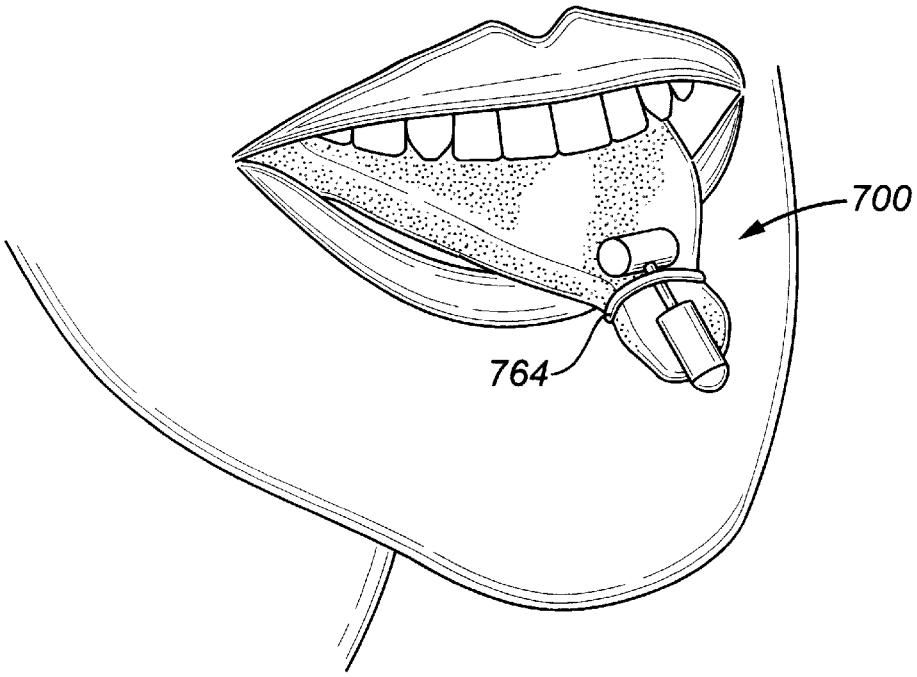
FIG. 7C is a perspective view of the preferred embodiment of the invention attached to a person's tongue with an elastomeric band.

FIG. 7B is a cross-sectional view of the preferred embodiment of the invention. In this preferred embodiment, batteries 722 and 723 are located within retainer 720. The vibrator is comprised of electromagnetic motor 724 and eccentric rotor 744. Battery end caps 714A are screwed into place with the help of battery end cap slots 730A, which further include vent holes 731A to allow air to energize the batteries.

As shown in FIG. 7B, batteries 722 and 723 are connected in parallel to motor 724. Batteries 722 and 723 are placed into retainer 720 with the cathode negative electrode end first. Positive lead wire 740 from motor 724 is attached to the inner periphery of housing 713. Negative lead wire 738 is fed through passage 752 in elongated post 718, where it terminates at negative battery contact 757 within contact tip assembly 725.

Figure 7D:
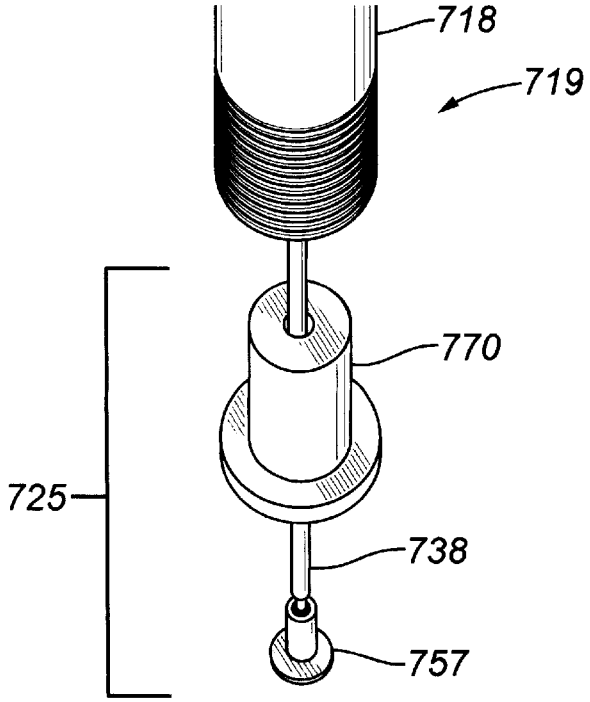
FIG. 7D is an exploded view of the post tip assembly of the preferred embodiment of the invention.

FIG. 7D is an exploded view of contact tip assembly 725, which is comprised of post insulator 770 and negative battery contact 757, each of which is attached at bottom end 719 of post 718. Negative motor lead wire 738 terminates at negative battery contact 757. Post insulator 770 insulates negative battery contact 757 from post 718.

Referring back to FIG. 7B, retainer 720 is screwed onto the threaded bottom end 719 of post 718. When retainer 720 is screwed into place, the parallel circuit between batteries 722 and 723, and motor 724, is completed as the negative ends of batteries 722 and 723 within retainer 720 communicate with negative battery contact 757. When retainer 720 is screwed into place, the positive ends of batteries 722 and 723 communicate with positive motor lead wire 740 through housing 713, elongated post 718, retainer 720, and battery end caps 714A.

A person wearing jewelry 700 as a barbell style tongue piercing, or alternatively with the elastomeric band, may turn on the vibrator by screwing down retainer 720 to the point at which it is fully seated, and then turn off the vibrator by slightly backing off the threads of retainer 720. This inventive on-off switch feature is accomplished with a threaded retainer, which is the standard barbell style tongue jewelry attachment mechanism, operating as the only necessary moving part other than the vibrator itself.

Further alternative embodiments of this invention, which would be apparent to those skilled in the art, include the placement of this inventive jewelry on parts of the body other than the tongue, the modification of the vibrator mechanism to include any of several known alternative structures for creating vibrations, and the use of light emitters in addition to or in place of the vibrator mechanism.

It is to be understood that the present invention is not limited to the embodiments described above, but encompasses any and all embodiments within the scope of the following claims.

We claim:

1. An apparatus comprising:

an elongated post with a first end and a second end;

a retainer connected to the first end of the post;

a housing body connected to the second end of the post; and the housing body enclosing a vibrator; and wherein the vibrator is an electromagnetic motor with an eccentric rotor;

the housing body encloses an electric power source; and the retainer bridges an electrical connection between the electric power source and the electromagnetic motor.

2. An apparatus comprising:

an elongated post with a first end and a second end;

a retainer connected to the first end of the post;

a housing body connected to the second end of the post; and the housing body enclosing a vibrator; and wherein the vibrator is an electromagnetic motor with an eccentric rotor; and the retainer encloses an electric power source.

3. An apparatus according to claim 2 in which:

the retainer bridges an electrical connection between the electric power source and the electromagnetic motor.

4. An apparatus according to claim 2 in which:

the electric power source is a battery having a positive pole and a negative pole; and the electromagnetic motor has a positive lead wire and a negative lead wire.

5. An apparatus according to claim 4 with:

the retainer having a first end and second end; and a battery cap attached to the first end of the retainer.

6. An apparatus according to claim 5 in which:

the positive lead wire of the electromagnetic motor is connected to the housing body;

the positive lead wire of the electromagnetic motor is electrically connected with the post through mutual communication with the housing body;

the first end of the elongated post has a tip electrically insulated from the post;

the tip is connected to the negative lead wire of the electromagnetic motor; and the battery cap attached to the retainer engages the positive pole of the battery in the retainer;

the retainer bridges an electrical connection between the electric power source and the electromagnetic motor when the retainer engages the tip.

7. An apparatus according to claim 5 in which:

the negative lead wire of the electromagnetic motor is connected to the housing body;

the negative lead wire of the electromagnetic motor is electrically connected with the post through mutual communication with the housing body;

the first end of the elongated post has a tip electrically insulated from the post;

the tip is connected to the positive lead wire of the electromagnetic motor; and the battery cap attached to the retainer engages the negative pole of the battery in the retainer;

the retainer bridges an electrical connection between the electric power source and the electromagnetic motor when the retainer engages the tip.

8. An apparatus according to claim 2 with:

the retainer enclosing a secondary electric power source.

9. An apparatus according to claim 8 in which:

the retainer bridges an electrical connection between the electric power sources and the electromagnetic motor.

10. An apparatus according to claim 2 further comprising:

a second elongated post with a first end and a second end;

a second retainer attached to the first end of the second elongated post;

a third retainer attached to the second end of the second elongated post; and the third retainer releasably attached to the first elongated post.

11. An apparatus according to claim 8 further comprising:

a second elongated post with a first end and a second end;

a second retainer attached to the first end of the second elongated post;

a third retainer attached to the second end of the second elongated post; and the third retainer releasably attached to the first elongated post.

12. An apparatus according to claim 2 further comprising:

an elastomeric band for attaching the apparatus to one's body.

13. An apparatus according to claim 8 further comprising:

an elastomeric band for attaching the apparatus to one's body.

14. An apparatus according to claim 2 further comprising:

a second elongated post with a first end and a second end;

the second end of the second elongated post connected to the housing body;

a second retainer connected to the first end of the second elongated post;

the second retainer enclosing an electric power source.

15. An apparatus according to claim 14 further comprising:

an elastomeric band for attaching the apparatus to one's body.

16. An apparatus comprising:

an elongated post with a first end and a second end;

a retainer connected to the first end of the post;

a housing body connected to the second end of the post; and the housing body enclosing a vibrator; and wherein the vibrator is an electromagnetic motor with an eccentric rotor;

the housing body encloses an electric power source;

the electric power source is a battery having a positive pole and a negative pole;

the electromagnetic motor has a positive lead wire and a negative lead wire;

the housing body has a first end and a second end;

a battery cap attaches to the first end of the housing body; and a motor cap attaches to the second end of the housing body.

17. An apparatus according to claim 16 in which:

the negative pole of the battery is connected to the negative lead wire of the electromagnetic motor;

the battery cap engages the positive pole of the battery;

the battery cap is electrically connected with the post through mutual communication with the housing body;

the first end of the elongated post has a tip electrically insulated from the post;

the tip is connected to the positive lead wire of the electromagnetic motor; and the retainer bridges an electrical connection between the electric power source and the electromagnetic motor when the retainer engages the tip.

18. An apparatus according to claim 16 in which:

the positive pole of the battery is connected to the positive lead wire of the electromagnetic motor;

the battery cap engages the negative pole of the battery;

the battery cap is electrically connected with the post through mutual communication with the housing body;

the first end of the elongated post has a tip electrically insulated from the post;

the tip is connected to the negative lead wire of the electromagnetic motor; and the retainer bridges an electrical connection between the electric power source and the electromagnetic motor when the retainer engages the tip.

19. An apparatus comprising:

an elongated post with a first end and a second end;

a retainer connected to the first end of the post;

a housing body connected to the second end of the post; and the housing body enclosing a vibrator; and wherein the vibrator is an electromagnetic motor with an eccentric rotor;

the housing body encloses an electric power source; and the retainer encloses a secondary power source.

20. An apparatus according to claim 5 in which:

the retainer bridges an electrical connection between the electric power sources and the electromagnetic motor.

21. An apparatus according to claim 19 further comprising:

a second elongated post with a first end and a second end;

a second retainer attached to the first end of the second elongated post;

a third retainer attached to the second end of the second elongated post; and the third retainer releasably attached to the first elongated post.

22. An apparatus according to claim 19 further comprising:

an elastomeric band for attaching the apparatus to one's body.

23. An apparatus comprising:

an elongated post with a first end and a second end;

a retainer connected to the first end of the post;

a housing body connected to the second end of the post; and the housing body enclosing a vibrator; and wherein the vibrator is an electromagnetic motor with an eccentric rotor;

the housing body encloses an electric power source;

the housing body has a first end and a second end;

a battery cap attaches to the first end of the housing body;

a motor cap attaches to the second end of the housing body;

the retainer encloses a secondary electric power source;

the retainer has a first end and a second end; and a secondary battery cap attaches to the first end of the retainer.

24. An apparatus according to claim 23 in which:

the retainer bridges an electrical connection between the electric power sources and the electromagnetic motor when the retainer is connected to the first end of the post.

25. An apparatus comprising:

a first elongated post with a first end and a second end;

a retainer connected to the first end of the post;

a housing body connected to the second end of the post; and the housing body enclosing a vibrator; the apparatus further comprising a second elongated post with a first end and a second end;

a second retainer attached to the first end of the second elongated post;

a third retainer attached to the second end of the second elongated post; and the third retainer releasably attached to the first elongated post.

26. An apparatus comprising:

a first elongated post with a first end and a second end;

a retainer connected to the first end of the post;

a housing body connected to the second end of the post; and the housing body enclosing a vibrator; and wherein the vibrator is an electromagnetic motor with an eccentric rotor;

the apparatus further comprising:

a second elongated post having a first end and a second end;

a second retainer attached to the first end of the second elongated post;

a third retainer attached to the second end of the second elongated post; and the third retainer releasably attached to the first elongated post.

27. An apparatus comprising:

a first elongated post with a first end and a second end;

a retainer connected to the first end of the post;

a housing body connected to the second end of the post; and the housing body enclosing a vibrator; and wherein the vibrator is an electromagnetic motor with an eccentric rotor; and an electric power source is located external to the apparatus and connected to the electromagnetic motor by wires;

the apparatus further comprising:

a second elongated post having a first end and a second end;

a second retainer attached to the first end of the second elongated post;

a third retainer attached to the second end of the second elongated post; and the third retainer releasably attached to the first elongated post.

28. An apparatus comprising:

a first elongated post with a first end and a second end;

a retainer connected to the first end of the post;

a housing body connected to the second end of the post; and the housing body enclosing a vibrator; and wherein the vibrator is an electromagnetic motor with an eccentric rotor; and the housing body encloses an electric power source;

the apparatus further comprising:

a second elongated post having a first end and a second end;

a second retainer attached to the first end of the second elongated post;

a third retainer attached to the second end of the second elongated post; and the third retainer releasably attached to the first elongated post.

* * * * *